US011337283B2

(12) United States Patent
Zhao

(10) Patent No.: US 11,337,283 B2
(45) Date of Patent: May 17, 2022

(54) DRIVE CONTROL SYSTEM FOR LIGHT-EMITTING DIODE STRING

(71) Applicant: HongChun Zhao, ShenZhen (CN)

(72) Inventor: HongChun Zhao, ShenZhen (CN)

( * ) Notice: Subject to any disclaimer, the term of this patent is extended or adjusted under 35 U.S.C. 154(b) by 0 days.

(21) Appl. No.: 17/198,892

(22) Filed: Mar. 11, 2021

(65) Prior Publication Data

US 2021/0212179 A1 Jul. 8, 2021

(30) Foreign Application Priority Data

Feb. 10, 2021 (CN) ..... 202110186441.5

(51) Int. Cl.
*H05B 45/34* (2020.01)
*H05B 45/44* (2020.01)

(52) U.S. Cl.
CPC ..... *H05B 45/34* (2020.01); *H05B 45/44* (2020.01)

(58) Field of Classification Search
CPC ..... H05B 45/34; H05B 45/44; H05B 45/30
USPC ..... 315/186–193, 291–307, 185 R
See application file for complete search history.

(56) References Cited

U.S. PATENT DOCUMENTS 8,344,659 B2 1/2013 Shimomura et al.
8,405,323 B2 3/2013 Finney et al.
9,380,662 B1 6/2016 Peng
9,723,679 B2 8/2017 Luo
10,129,959 B2 11/2018 Luo
10,517,150 B1 12/2019 Zhen
10,667,354 B2 5/2020 Zhen
10,863,608 B2 12/2020 Zhen
2010/0308738 A1* 12/2010 Shteynberg ..... H05B 45/48 315/185 R
2011/0273102 A1* 11/2011 van de Ven ..... H05B 45/40 315/193
2013/0049618 A1* 2/2013 Radermacher ..... H05B 45/37 315/200 R
2013/0249426 A1* 9/2013 Tao ..... H05B 47/16 315/201
2013/0313983 A1* 11/2013 Radermacher ..... H05B 45/37 315/187
2014/0145632 A1* 5/2014 Wey ..... H05B 45/44 315/193
2014/0300274 A1* 10/2014 Acatrinei ..... H05B 45/382 315/85

(Continued)

*Primary Examiner* — Alexander H Taningco
*Assistant Examiner* — Amy X Yang
(74) *Attorney, Agent, or Firm* — iPA & iPM

(57) ABSTRACT

The present disclosure relates to a drive control system for a light-emitting diode string, comprising a control unit and a signal-generating unit. The signal-generating unit comprises a switching element with a first terminal, a second terminal and a control terminal. One end of the control unit is connected to the control terminal, and the second terminal is connected to a negative terminal of the light-emitting diode string. A voltage stabilizing circuit is connected to the negative terminal of the light-emitting diode string, wherein a positive terminal of the light-emitting diode string is connected to a power supply unit. When the control unit turns on the switching element, the power supply unit directly drives the light-emitting diode string to emit light. When the control unit turns off the switching element, the power supply unit drives the light-emitting diode string to emit light through the voltage stabilizing circuit.

6 Claims, 4 Drawing Sheets

(56) References Cited

U.S. PATENT DOCUMENTS

| | | | | |
|---|---|---|---|---|
| 2015/0237699 | A1* | 8/2015 | Kim | H05B 45/44 315/186 |
| 2017/0238401 | A1* | 8/2017 | Sadwick | H05B 47/195 315/294 |
| 2020/0060000 | A1 | 2/2020 | Zhen | |
| 2020/0296809 | A1 | 9/2020 | Zhen | |

* cited by examiner

DRIVE CONTROL SYSTEM FOR LIGHT-EMITTING DIODE STRING

TECHNICAL FIELD

The disclosure relates to a drive control system for a light-emitting string, in particular to a drive control system for a light-emitting diode string.

BACKGROUND ART

Currently, connecting modes of light-emitting diode strings generally include series connection and parallel connection. A series-connected string has a plurality of light-emitting diodes connected in series, and has a high failure rate during use. If one light-emitting diode fails, all other light-emitting diodes cannot be turned on. Thus, currently most light-emitting diode strings adopt the parallel connection mode. For example, Chinese patent CN210274608U discloses a control system for a light-emitting diode string, as shown in FIG. 1. The drive control system drives the light-emitting diode string to achieve light emission change by using a light emission control command sent by the control unit to light-emitting diodes. The control unit controls the on/off of a switching unit and cooperates with a second power source to generate a signal sequence to achieve synchronous or point-control operation of a number of light-emitting diodes connected in parallel.

As a drive control circuit in this patent uses a positive electrode of the light-emitting diode string to implement drive, and a power supply voltage of a main control circuit of the system is lower than that of the light-emitting diode string, the control circuit cannot normally control the on/off of the switching unit, and thus this patent usually can only be used to control and drive a single light-emitting diode string, and the connection of the light-emitting diode string is limited to a parallel connection mode, and it cannot be used for driving 2 or more light-emitting diode strings, or a light-emitting diode string connected in series. In practice, when 2 or more light-emitting diode strings need to be driven, a large number of electronic components are usually required, and a complicated circuit is not conducive to cost control. Moreover, this patent is also limited by the weak power supply capability of the second power source, and cannot achieve a good driving effect when the number of light-emitting diode strings is large.

Further, Chinese Patent CN102696282 also proposes a light-emitting diode driving solution, but its technical solution is obviously limited to driving a light-emitting diode string connected in series. Moreover, in the use of the light-emitting diode string of this technical solution, at least one capacitor needs to be added to each LED unit to store a reservoir of power for driving an LED control circuit and LEDs on the individually controlled LED unit. As a result, circuits and lines of the light-emitting string drive control system are very complicated, which is not conducive to cost control of a product on the one hand, and has an adverse effect on the simplicity and beauty of the product on the other hand.

Therefore, using a simple driving circuit to implement a drive control system with low power consumption that can drive both parallel-connected light-emitting diode strings and series-connected light-emitting diode strings is a problem to be solved by the present disclosure.

SUMMARY OF THE INVENTION

A technical problem to be solved by the present disclosure is to provide a two-wire drive control system for a light-emitting diode string, in which a negative electrode of the string is driven by electrically connecting a signal generating unit to a cathode terminal of light-emitting diodes; the system has strong driving capability, which facilitates driving light-emitting diode strings of various connecting modes; and the signal generating unit can be implemented by a switching element and a voltage stabilizing element, so that the circuit of the present disclosure is simple and the product cost is reduced; moreover, the light-emitting diodes of the present disclosure may be connected in series, or in parallel, or in a combination of the two modes, thereby solving the above technical problems.

To achieve the above object, the present disclosure provides a two-wire drive control system for a light-emitting diode string, including a control unit and a signal generating unit, the signal generating unit including:

a switching element including a first terminal, a second terminal and a control terminal, one end of the control unit being electrically connected to the control terminal, and the second terminal being electrically connected to a negative terminal of the light-emitting diode string; and a voltage stabilizing element electrically connected to the negative terminal of the light-emitting diode string, wherein a positive terminal of the light-emitting diode string is electrically connected to a power supply unit; the control unit is configured to control the switching element to be turned on, and the power supply unit is configured to directly drive the light-emitting diode string to emit light; and the control unit is further configured to control the switching element to be turned off, and the power supply unit is configured to drive the light-emitting diode string to emit light through the voltage stabilizing element.

According to the above-mentioned drive control system for a light-emitting diode string, the voltage stabilizing element is a voltage stabilizing diode.

According to the above-mentioned drive control system for a light-emitting diode string, the voltage stabilizing element includes a voltage stabilizing circuit, which includes at least a Darlington transistor circuit.

According to the above-mentioned drive control system for a light-emitting diode string, the voltage stabilizing circuit includes a first transistor, a second transistor, a fourth resistor, a fifth resistor, a sixth resistor, and a capacitor, wherein a collector of the first transistor is electrically connected to a current source through the fourth resistor; a base of the first transistor is electrically connected to a collector of the second transistor; an emitter of the second transistor is connected to the cathode of the light-emitting diode string, and a base of the second transistor is electrically connected to the current source through the fifth resistor; and the sixth resistor and the capacitor are electrically connected to the base of the second transistor respectively.

According to the above-mentioned drive control system for a light-emitting diode string, the system further includes a short-circuit protection unit, which is electrically connected to the first terminal of the switching element and an anode terminal of the voltage stabilizing element, respectively.

According to the above-mentioned drive control system for a light-emitting diode string, the wireless receiving unit includes:

a voltage stabilizing chip configured to convert a DC power supply into a working voltage of the wireless receiving chip, the voltage stabilizing chip being connected to the DC power supply and a power terminal of the wireless receiving chip, respectively.

According to the above-mentioned drive control system for a light-emitting diode string, the system further includes a storage unit configured to store address codes and color codes of the light-emitting diode string and light emission patterns, the storage unit being electrically connected to the control unit.

According to the above-mentioned drive control system for a light-emitting diode string, the first transistor is an NPN transistor, and the second transistor is a PNP transistor.

According to the above-mentioned drive control system for a light-emitting diode string, the switching element is a field effect transistor, and the control unit includes a microprocessor.

The present disclosure has the following beneficial effects: The present disclosure implements negative electrode drive of the string by electrically connecting the signal generating unit to the cathode terminal of the light-emitting diodes, and the control unit can control the switching element to be turned on/off without a high voltage. There is no need to boost the voltage between the control unit and the string. Regardless of the number of the light-emitting diode strings, and the connecting mode of the light-emitting diode string, the control voltage of the switching unit does not need to be changed. The system has higher driving capability than in a positive electrode drive mode, while the string is difficult to drive in the positive electrode drive mode if the power of the string is high. The signal generating unit in the present disclosure only needs two electronic components (such as a CMOS transistor and a voltage stabilizing diode) to drive the light-emitting diodes to emit light. Therefore, the circuit of the present disclosure is simple and can achieve more economical and practical effects. In addition, because the present disclosure can drive the light-emitting diodes without providing a second voltage source, the power supply and signal transmission are more stable in the present disclosure.

REFERENCE NUMERALS

1: drive control system for light-emitting diode string;

11: control unit;

12: signal generating unit; 121: switching element; 122: voltage stabilizing element;

13: power supply unit;

14: light-emitting diode string;

15: wireless receiving unit;

16: storage unit;

17: short-circuit protection unit.

DETAILED DESCRIPTION OF EMBODIMENTS

Figure 1:
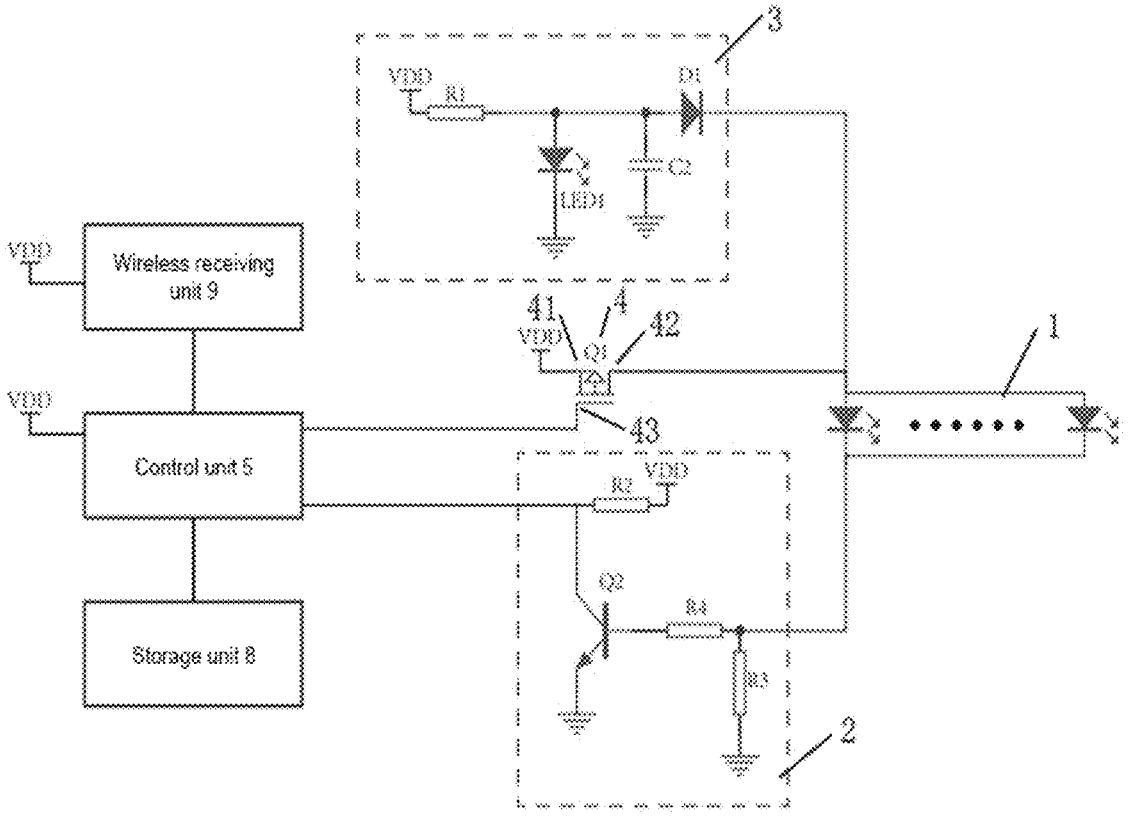
FIG. 1 is a circuit diagram of a light-emitting diode string control system in the prior art.
Figure 2:
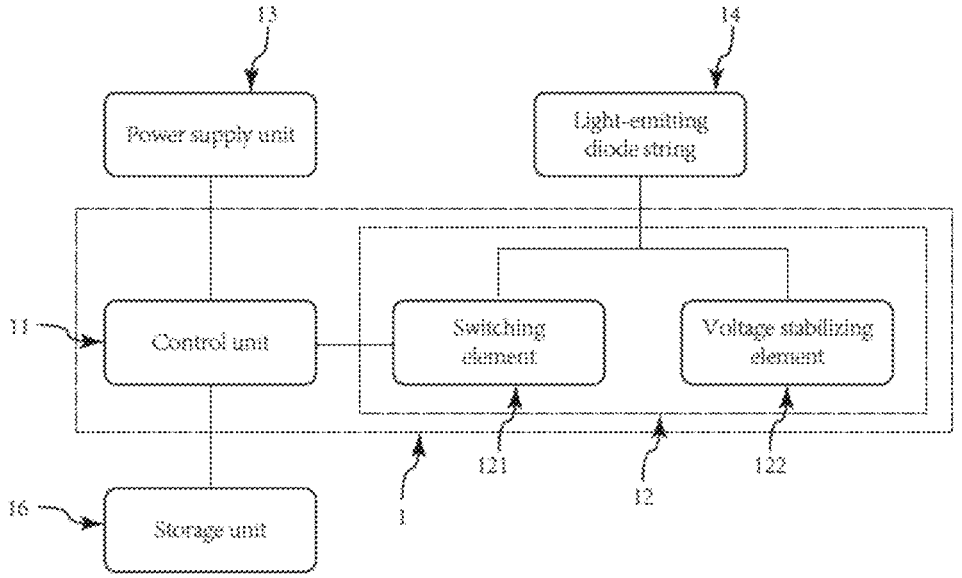
FIG. 2 is a block diagram of a drive control system for a plurality of light-emitting diode strings in an embodiment of the present disclosure.
Figure 3:
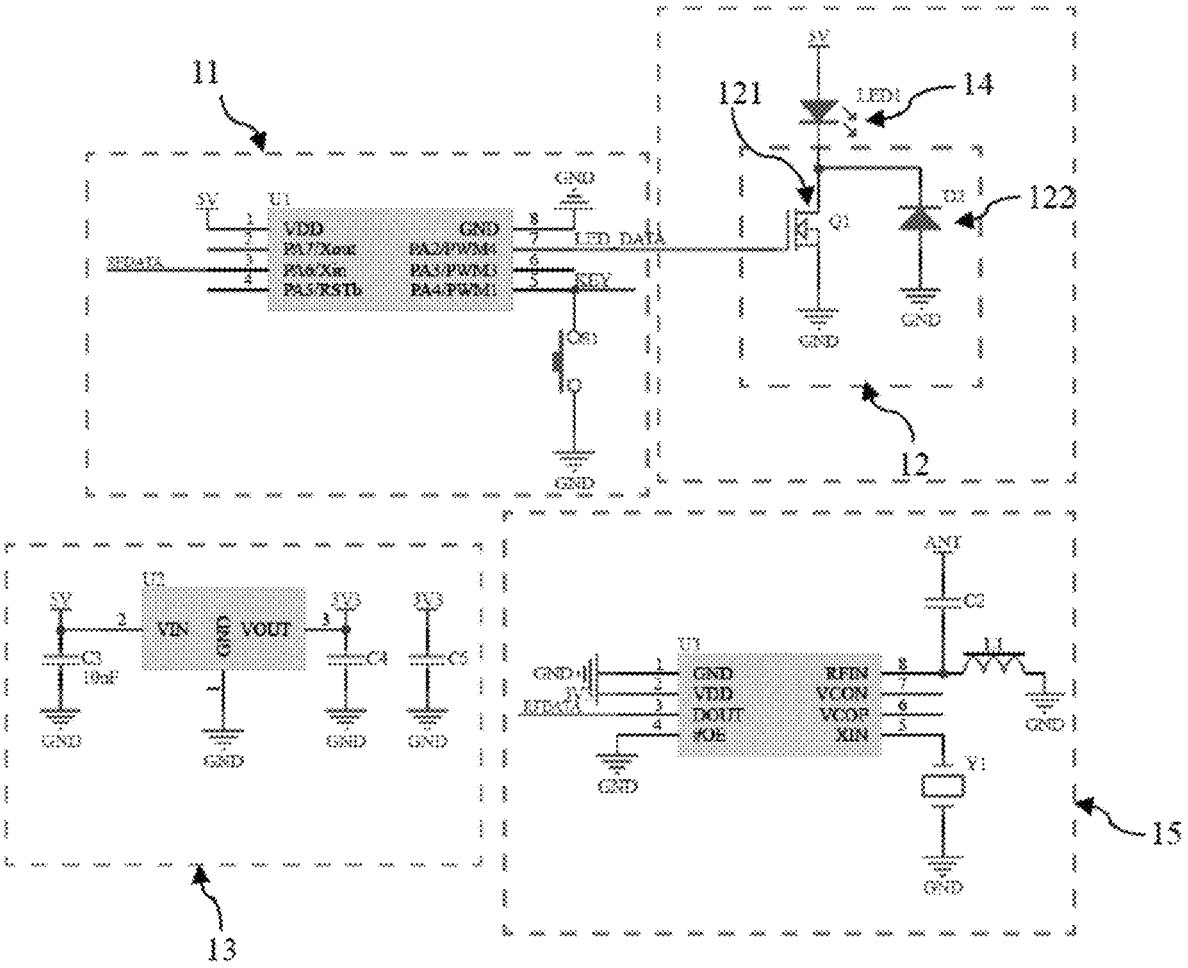
FIG. 3 is a circuit diagram of a drive control system for a plurality of light-emitting diode strings in an embodiment of the present disclosure.

The structural principle and working principle of the present disclosure will be described in detail below in conjunction with the accompanying drawings:

As shown in FIGS. 2 and 3, FIG. 2 is a block diagram of a drive control system for a plurality of light-emitting diode strings in an embodiment of the present disclosure, and FIG. 3 is a circuit diagram of a drive control system for a plurality of light-emitting diode strings in an embodiment of the present disclosure.

The two-wire drive control system for a light-emitting diode string of the present disclosure can be mainly used for drive control of a plurality of light-emitting diode strings connected in parallel or in series.

As shown in FIG. 2, in the embodiment of the present disclosure, the two-wire drive control system 1 for a light-emitting diode string includes a control unit 11 and a signal generating unit 12, wherein one end of the control unit 11 is electrically connected to a power supply unit 13, and the other end thereof is electrically connected to the signal generating unit 12; one end of the signal generating unit 12 is configured to be electrically connected to a negative electrode of a light-emitting diode string 14; and a positive electrode of the light-emitting diode string is connected to the power supply unit 13.

In particular, the signal generating unit 12 includes a switching element 121 and a voltage stabilizing element 122, the switching element 121 including a first terminal, a second terminal, and a control terminal. The control unit 11 is electrically connected to the control terminal of the switching element 121, and is configured to generate a pulse signal to control the switching element 121; the first terminal of the switching element 121 is grounded, and the second terminal thereof is electrically connected to the negative electrode of the light-emitting diode string 14; and a cathode terminal of the voltage stabilizing element 122 is connected to the negative electrode of the light-emitting diode string 14, and an anode terminal of the voltage stabilizing element 122 is connected to the ground. In the drive control system 1 of the present disclosure, as the signal generating unit 12 is connected to the negative electrode of the light-emitting diode string 14, the light emission and light-emission change of the string 14 are controlled by driving the negative electrode of the light-emitting diode string 14, to achieve the technical purpose of driving a plurality of strings connected in parallel and/or in series by configuration of a simple circuit.

As shown in FIG. 3, the control unit 11 is electrically connected to the control terminal of the switching element 121. When receiving a light emission signal, the control unit 11 sends a control signal to the control terminal of the switching element 121 to control an on or off state of the switching element 121. For example, a number of light emission patterns (such as light-emitting colors and brightness, etc.) are set for the control unit 11, and the control unit 11 generates a corresponding light emission control signal according to a selected light emission pattern. When there is no need to generate different light emission patterns, the control unit 11 does not generate a corresponding light emission control signal. In this case, the control unit 11 generates a high-level signal to control the switching element 121 to be turned on, and potentials of the negative electrode of the light-emitting diode string 14 and the cathode of the voltage stabilizing element 122 are pulled to a low level (i.e. 0 potential GND) by the switching element 121, and the power supply unit 13 forms a loop through the light-emitting diode string 14 and the switching element 121, so that the power supply unit 13 can directly drive the light-emitting diode string 14 to emit light. The voltage stabilizing element 122 is bypassed by the switching element 121 and thus does not operate, and a negative electrode voltage of the light-emitting diode string 14 is equal to a negative electrode voltage of the power supply unit 13. When a different light emission pattern needs to be generated, the control unit 11 generates a corresponding light emission control signal, and controls the switching element 121 to be turned on or off according to the light emission control signal. When the control unit 11 generates a low-level signal and the control switching element 121 is turned off, the power supply unit 13 forms a power supply loop through the light-emitting diode string 14 and the voltage stabilizing element 122, and a cathode potential of the string is pulled up by the voltage stabilizing element 122 to the same potential (the specific value depends on parameters of a voltage stabilizing diode itself, and is equivalent to a high level) as the voltage stabilizing element, and a negative electrode voltage of the light-emitting diode string 14 is a voltage of the voltage stabilizing element 122; and the power supply unit 13 provides a voltage to the light-emitting diode string 14 through the voltage stabilizing element 122 to power the light-emitting diode string 14. A frame of signal is generated according to a combination of turning on and off multiple times in certain rule, and a chip in the string automatically recognizes the generated frame of signal to achieve color change of a relevant function.

Figure 4:
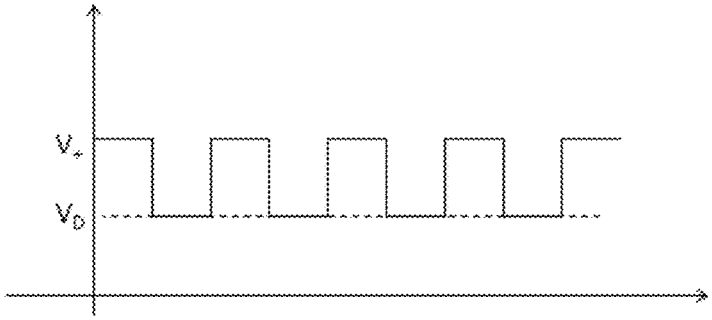
FIG. 4 is a schematic diagram of periodic variations of a voltage drop of a light-emitting diode string of a drive control system for a plurality of light-emitting diode strings in an embodiment of the present disclosure.

In the above two situations, there is a difference in the voltage drop of the light-emitting diode string 14. As shown in FIG. 4, when the control unit 11 generates a high-level signal and controls the switching element 121 to be turned on, the voltage drop of the light-emitting diode string 14 is equal to a supply voltage $V_+$ of the power supply unit 13; and when the control unit 11 generates a low-level signal and controls the switching element 121 to be turned off, the voltage drop of the light-emitting diode string 14 is equal to a voltage $V_D$ of the voltage stabilizing element 122. As the control unit controls the switching element 121 to be turned on/off, the voltage drop of the light-emitting diode string 14 changes periodically.

It is to be noted that for the two-wire drive control system for a light-emitting diode string provided by the present disclosure, that is, in the present disclosure, the light emission signal is transmitted on a power line to control light emission of light-emitting diodes by means of a carrier wave, so lines actually involved in the present disclosure are relatively simple, which not only saves costs, but also achieves simpler wiring of a product and is more in line with market needs.

The power supply unit 13 in this embodiment provides, for example, DC power of +5V, and the control unit 11 includes, for example, a microprocessor and a voltage stabilizer (not shown in the figure), which has an input terminal connected to the power supply unit 13, and an output terminal connected to a power terminal of the microprocessor, and the voltage stabilizer is configured to convert the power supply unit 13 into a working voltage of the microprocessor. The switching element 121 is, for example, an N-channel enhancement mode field effect transistor Q1, and field effect transistor Q1 has a gate connected to the control unit 11, and a drain connected to the negative electrode of the light-emitting diode string 14. The voltage stabilizing element 122 is, for example, a voltage stabilizing diode D2, and a cathode terminal of the voltage stabilizing diode D2 is connected to the negative electrode of the light-emitting diode string 14. As described above, when the control unit 11 controls the field effect transistor Q1 to be turned on, the power supply unit 13 can directly drive the light-emitting diode string 14 to emit light, and when the control unit 11 controls the field effect transistor Q1 to be turned off, the power supply unit 13 forms a power supply loop through the light-emitting diode string 14 and the voltage stabilizing diode D2 and provides a stable voltage to the light-emitting diode string 14. At this time, the voltage stabilizing diode D2 is a load element of the loop, and a negative electrode voltage of the light-emitting diode string 14 is a voltage of the voltage stabilizing diode D2. In fact, in this case, the voltage stabilizing diode D2 draws electric energy of the power supply unit through the light-emitting diode string 14 to turn on the light-emitting diode string 14 to emit light.

When the number of light-emitting diode strings 14 connected in series is different, the required voltage is also different, so different voltage values of the voltage stabilizing diodes can be set according to different numbers of strings to adapt to different numbers of strings, thereby achieving the purpose of capable of driving different numbers of light-emitting diode strings. In this way, the control unit 11 controls the turning on and off operations of the switching element 121 and the operation state of the voltage stabilizing element 122 to determine a light emission voltage of the light-emitting diode string 14, thereby achieving the corresponding light emission change of the light-emitting diode string 14.

It can be seen from the above-mentioned drive control process of the light-emitting diode string that, compared with the prior art, the drive control system of the present disclosure can implement the light emission drive of the light-emitting diode string only by means of the switching element 121 and the voltage stabilizing element 122 in the signal generating unit 12, so the present disclosure achieves a simple circuit, more stable signal transmission, better signal quality, and a lower error rate.

In addition, as the present disclosure uses a single current source, the power supply is more stable. The present disclosure uses the signal generating unit 12 connected to the negative electrode of the light-emitting diode string 14 to drive the string, and the positive electrode of the string is connected with the voltage unit 13, so the control unit 11 can control the switching element 121 to be turned on and off without a high voltage, and voltage boosting is not needed between the control unit 11 and the light-emitting diode string 14. On the whole, compared with positive electrode drive of the string, driving the light-emitting diode string 14 to emit light by the drive control system 1 of the present disclosure has the advantages that the drive capability of the voltage stabilizing element 122 is more sufficient, and the luminance variation period of the string is smaller, and the luminous effect of the string is more stable. Moreover, in the present disclosure, since the current of the field effect transistor Q1 is small, its power consumption is low, and the cost can be saved to a large extent while ensuring effective drive.

Still as shown in FIG. 2, the drive control system 1 of this embodiment further includes a wireless receiving unit 15 and a storage unit 16, wherein the wireless receiving unit 15 is connected to the control unit 11 and the power supply unit 13, and the wireless receiving unit 15 is wirelessly connected with an external remote control by an infrared or radio wave. The wireless receiving unit 15 receives an external wireless signal with a light emission pattern code, converts the wireless signal into a control signal of the control unit 11 and sends the control signal to the control unit 11. A number of light emission patterns are set for the control unit 11, and based on a selected light emission pattern, the control unit 11 generates a corresponding light emission signal according to the light emission pattern code containing address code and color code information. The storage unit 16 is connected to the control unit 11, and the storage unit 16 is configured to store address codes and color codes of the light-emitting diode string 14 and the last light emission pattern used before the control unit 11 is turned off. The wireless receiving unit 15 includes a voltage stabilizing chip and a wireless receiving chip, wherein the voltage stabilizing chip is connected to a DC power supply VDD and configured to convert the DC power supply VDD into a working voltage of the wireless receiving chip; the voltage stabilizing chip is connected to a power terminal of the wireless receiving chip; an output terminal of the wireless receiving chip is connected to the control unit 11; and an input terminal of the wireless receiving chip receives a wireless signal from the external remote controller.

Figure 5:
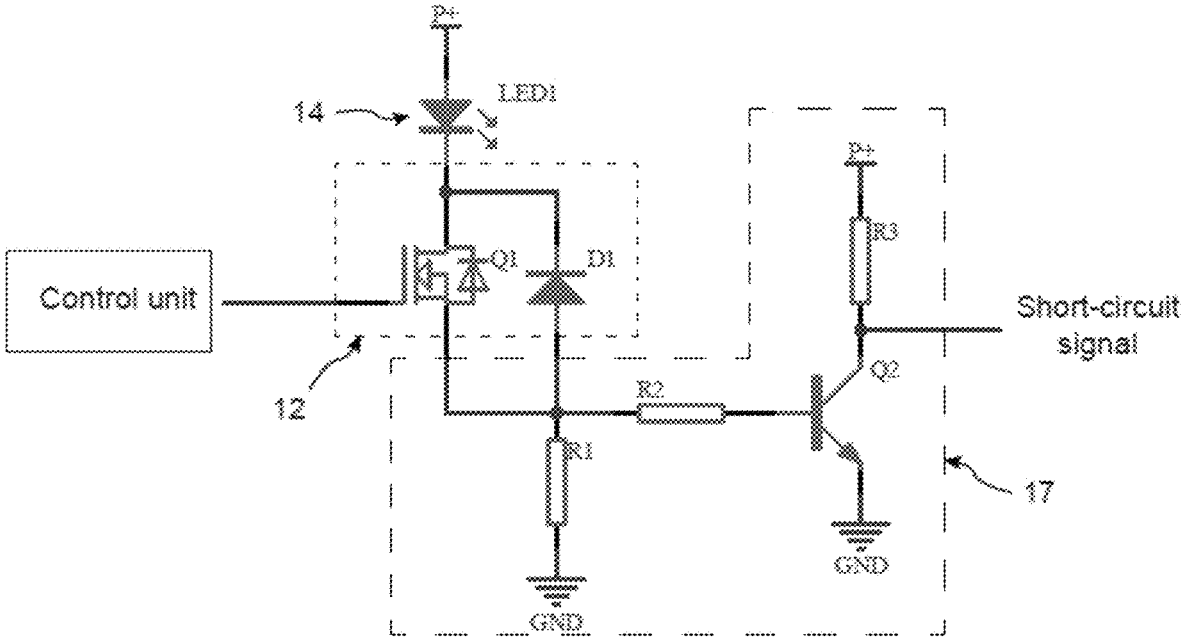
FIG. 5 is a circuit diagram of short-circuit protection unit in an embodiment of the present disclosure.

In addition, as the present disclosure is mostly used on the outside of buildings, trees, signboards and landscapes, thus, to ensure safety and product use effects, the present disclosure also provides a short-circuit protection unit 17, which is configured to detect in real time whether there is a short circuit in the light-emitting diode string 14 and make a quick response when the light-emitting diode string 14 is short-circuited. As shown in FIGS. 2 and 5, FIG. 5 is a circuit diagram of the short-circuit protection unit 17 of the present disclosure. The short-circuit protection unit 17 is electrically connected to the signal generating unit 12 and the power supply unit 13 respectively. Specifically, the short-circuit protection unit 17 is electrically connected to the first terminal of the switching element 121 and the anode terminal of the voltage stabilizing element 122, respectively, and is electrically connected to the control unit 11 to send a short-circuit signal to the control unit when a short circuit occurs, so that the control unit 11 disconnect a light emission circuit of the light-emitting diode string 14. As shown in FIG. 5, the short-circuit protection unit 17 includes a first resistor R1, a second resistor R2, a third resistor R3, and a triode Q2 (for example, an NPN transistor), wherein a source terminal of the field effect transistor Q1 is connected to the first resistor R1 and the second resistor R2; the other end of the first resistor R1 is grounded; the other end of the second resistor R2 is connected to a base of the transistor Q2; and an emitter of the transistor Q2 is grounded, and a collector of the transistor is connected to the control unit 11, and is connected to the power supply unit 13 via the first resistor R1. The first resistor R1 is configured to improve the reliability of a signal output of the short-circuit protection unit 17. In other embodiments, as a port of the control unit 11 connected with the short-circuit protection unit 17 automatically has a high level when there is no signal input, the collector can be directly connected to the control unit 11 without connecting to the first resistor R1 and the power supply unit 13; and when the transistor Q2 is turned off, the short-circuit protection unit 17 does not output a signal to the control unit 11.

Figure 6:
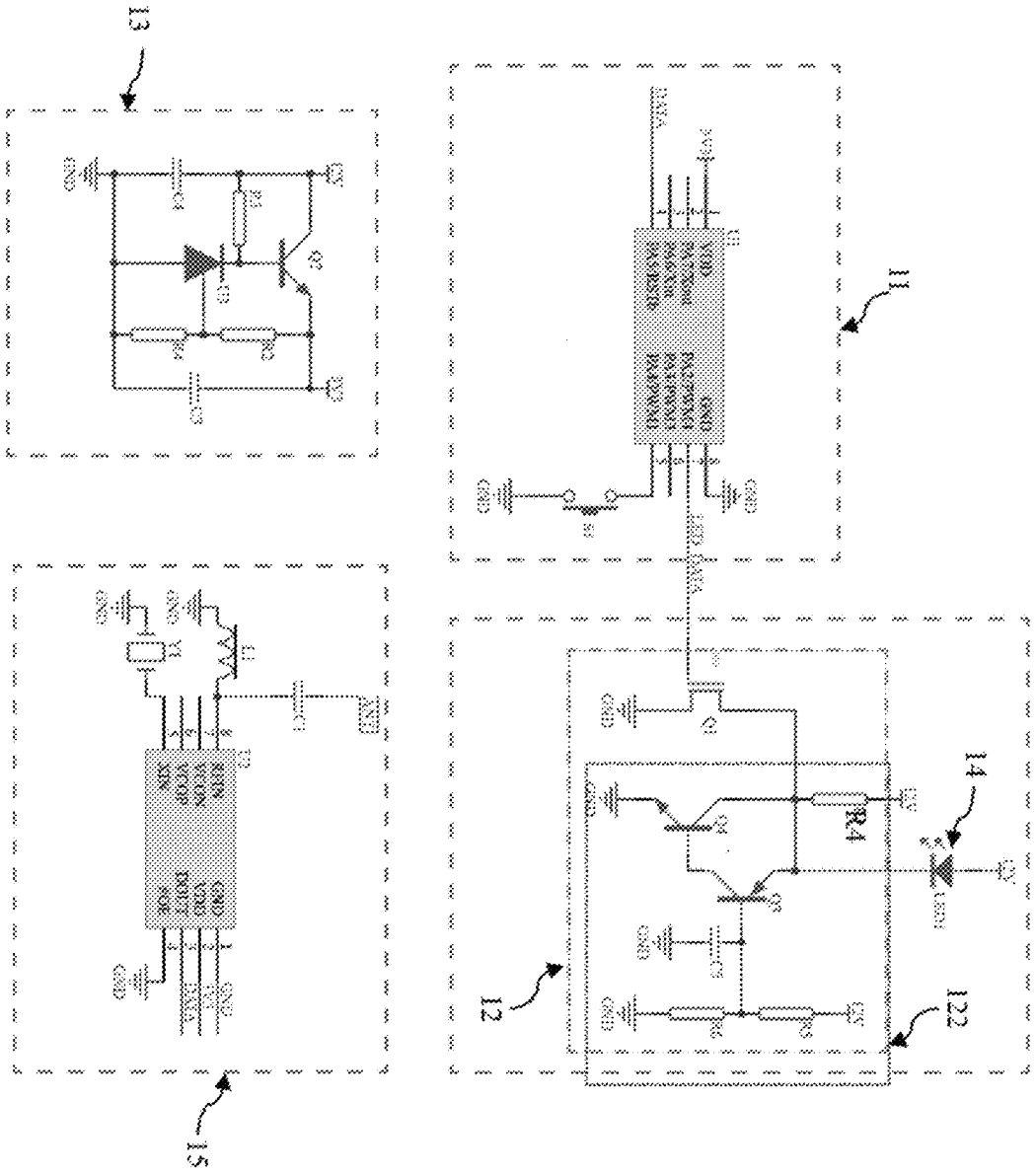
FIG. 6 is a block diagram of a drive control system for a plurality of light-emitting diode strings in another embodiment of the present disclosure.

Further referring to FIG. 6, FIG. 6 is a circuit diagram of a drive control system for a plurality of light-emitting diode strings in another embodiment of the present disclosure. The drive control system for a light-emitting diode string of this embodiment differs from the drive control system shown in FIG. 3 in that the implementation circuit of the voltage stabilizing element 122 is different. As shown in FIG. 6, the voltage stabilizing element 122 of this embodiment is composed of a voltage stabilizing circuit, which includes two transistors (a first transistor Q4 and a second transistor Q3), wherein the first transistor Q4 is, for example, an NPN transistor, and the second transistor Q3 is, for example, a PNP transistor. A Darlington transistor circuit is formed between the two transistors, wherein a collector of the first transistor Q4 is electrically connected to a current source through a fourth resistor R4; a base of the first transistor Q4 is electrically connected to a collector of the second transistor Q3; an emitter of the second transistor Q3 is connected to the cathode of the light-emitting diode string 14, and a base of the second transistor Q3 is electrically connected to the current source through a fifth resistor R5; and a capacitor C5 and a sixth resistor R6 connected in parallel are respectively provided between the base of the second transistor Q3 and the fifth resistor R5, and one end of the capacitor C5 and one end of the sixth resistor R6 are grounded respectively.

The control unit 11 generates a high-level signal to control the switching element 121 to be turned on, and the power supply unit 13 forms a loop through the light-emitting diode string 14 and the switching element 121, so that the power supply unit 13 can directly drive the light-emitting diode string 14 to emit light. The voltage stabilizing circuit is bypassed by the switching element 121 and thus does not operate, and a negative electrode voltage of the light-emitting diode string 14 is equal to a negative electrode voltage of the power supply. When a different light emission pattern needs to be generated, the control unit 11 generates a corresponding light emission control signal, and controls the switching element 121 to be turned on or off according to the light emission control signal. When the control unit 11 generates a low-level signal and the control switching element 121 is turned off, the power supply unit 13 forms a power supply loop through the light-emitting diode string 14 and the voltage stabilizing circuit, and a negative electrode voltage of the light-emitting diode string 14 is a voltage of the voltage stabilizing element 122. Multiple high-level and low-level signal sequences are combined into a frame signal. For example, 00001000 represents 0x08 (8421 code for hexadecimal), 00010001 represents 0x11 (8421 code for hexadecimal). The specific time width parameter depends on model parameters of the voltage stabilizing diode itself.

This embodiment uses a half voltage divider circuit, a line voltage of which automatically changes according to a change of the supply voltage, and is always approximately equal to half of the supply voltage. Specifically, this embodiment can use a corresponding voltage to match the string with without changing the light-emitting diodes. For example, if the string voltage is 3V, a power supply of 5V-6V can be used to achieve light emission. If the string voltage is 6V, a power supply of 10V-12V can be used to achieve light emission. Thus, electronic parts can be stocked in large quantities, and components in the circuit do not need to be changed.

Of course, the present disclosure may also have various other embodiments. Those skilled in the art can make various corresponding changes and modifications according to the present disclosure without departing from the spirit and essence of the present disclosure, but all these corresponding changes and deformations shall be encompassed within the protection scope of the appended claims of the present disclosure.

What is claimed is:

1. A drive control system for a light-emitting diode string, comprising a control unit and a signal generating unit, the signal generating unit comprising:

a switching element, comprising a first terminal, a second terminal and a control terminal, one end of the control unit is connected to the control terminal, and the second terminal is connected to a negative terminal of the light-emitting diode string; and a voltage stabilizing circuit is connected to the negative terminal of the light-emitting diode string, a positive terminal of the light-emitting diode string is connected to a power supply unit; when the control unit is configured to output a high level to turn on the switching element the voltage stabilizing circuit is bypassed, and the power supply unit is configured to provide a voltage to the light-emitting diode string; and when the control unit is configured to output a low level to turn off the switching element, the negative terminal of the light-emitting diode string has a higher level, and the power supply unit is configured to provides a voltage to the light-emitting diode string through the voltage stabilizing circuit, which comprises a first transistor, a second transistor, a first resistor, a second resistor, a third resistor, and a capacitor, wherein a collector of the first transistor is connected to a current source through the first resistor; a base of the first transistor is connected to a collector of the second transistor; an emitter of the second transistor is connected to the cathode of the light-emitting diode string, and a base of the second transistor is connected to the current source through the second resistor; and the third resistor and the capacitor is connected to the base of the second transistor respectively.

2. The drive control system for a light-emitting diode string according to claim 1, wherein the voltage stabilizing circuit comprises at least a Darlington transistor circuit.

3. The drive control system for a light-emitting diode string according to claim 1, further comprising a storage unit configured to store address codes and color codes of the light-emitting diode string and light emission patterns, the storage unit is connected to the control unit.

4. The drive control system for a light-emitting diode string according to claim 1, wherein the first transistor is an NPN transistor, and the second transistor is a PNP transistor.

5. The drive control system for a light-emitting diode string according to claim 1, wherein connecting modes of the light-emitting diode string comprise parallel connection and/or serial connection.

6. The drive control system for a light-emitting diode string according to claim 1, wherein the switching element is a field effect transistor, and the control unit comprises a microprocessor.

* * * * *